US007666028B2

(12) United States Patent
Meleck

(10) Patent No.: US 7,666,028 B2
(45) Date of Patent: Feb. 23, 2010

(54) CAB POWER CONNECTORS

(75) Inventor: Michael Meleck, Chaska, MN (US)

(73) Assignee: Phillips & Temro Industries Inc., Eden Prairie, MN (US)

( * ) Notice: Subject to any disclaimer, the term of this patent is extended or adjusted under 35 U.S.C. 154(b) by 0 days.

(21) Appl. No.: 12/051,136

(22) Filed: Mar. 19, 2008

(65) Prior Publication Data

US 2008/0233773 A1 Sep. 25, 2008

Related U.S. Application Data

(60) Provisional application No. 60/919,319, filed on Mar. 21, 2007.

(51) Int. Cl.
*H01R 11/00* (2006.01)

(52) U.S. Cl. ..... 439/502; 439/680

(58) Field of Classification Search ..... 439/502, 439/503, 677, 680; 174/72 A
See application file for complete search history.

(56) References Cited

U.S. PATENT DOCUMENTS

| | | | |
|---|---|---|---|
| 3,858,140 | A | 12/1974 | Hancock |
| 3,898,547 | A | 8/1975 | Poole |
| 4,538,134 | A | 8/1985 | Carey |
| 4,570,145 | A | 2/1986 | Carey |
| 4,699,445 | A | 10/1987 | Porta et al. |
| 5,080,600 | A | 1/1992 | Baker et al. |
| 5,088,835 | A | 2/1992 | Shigezawa et al. |
| 5,181,866 | A | 1/1993 | Jerome et al. |
| 5,188,542 | A | 2/1993 | Ballman |
| 5,320,563 | A | 6/1994 | Liao |
| 5,344,330 | A | 9/1994 | Hoffman |
| 5,384,559 | A | 1/1995 | Shamir |
| 5,538,439 | A | 7/1996 | Fell et al. |
| 5,590,010 | A | 12/1996 | Ceola et al. |
| 5,618,198 | A | 4/1997 | Sato et al. |
| 5,742,464 | A | 4/1998 | Ceola et al. |
| 5,777,868 | A | 7/1998 | Gibboney, Jr. |
| 5,885,098 | A | 3/1999 | Witkowski |
| 5,921,799 | A | 7/1999 | Forrester |
| 5,930,097 | A | 7/1999 | Ceola et al. |
| 5,937,140 | A | 8/1999 | Leonard et al. |
| 6,010,348 | A | 1/2000 | Alden |
| 6,036,530 | A | 3/2000 | Edwards et al. |
| 6,039,602 | A | 3/2000 | Witkowski et al. |
| 6,072,152 | A | 6/2000 | Landry |
| 6,171,118 | B1 | 1/2001 | Witkowski et al. |
| 6,179,654 | B1 | 1/2001 | Witkowski et al. |
| 6,203,354 | B1 | 3/2001 | Kuwahara et al. |
| 6,257,923 | B1 | 7/2001 | Stone et al. |
| 6,377,029 | B1 | 4/2002 | Krieger et al. |
| 6,448,863 | B1 | 9/2002 | Ogawa et al. |
| 6,644,987 | B2 | 11/2003 | Meleck |
| 7,052,282 | B2 | 5/2006 | Meleck et al. |
| 7,070,417 | B2 | 7/2006 | Meleck et al. |

FOREIGN PATENT DOCUMENTS

| | | |
|---|---|---|
| CA | 2135948 | 5/1996 |

*Primary Examiner*—Khiem Nguyen
(74) *Attorney, Agent, or Firm*—Harness, Dickey & Pierce, P.L.C.

(57) ABSTRACT

A wiring arrangement for interconnecting an alternating current power source to a receptacle within a motor vehicle includes a first wire harness having a current rating and a second wire harness having a similar current rating. A coupling mechanism electrically interconnects the first and second wire harnesses of similar current ratings. The coupling mechanism restricts interconnection of wire harnesses having dissimilar current ratings.

9 Claims, 2 Drawing Sheets

CAB POWER CONNECTORS

CROSS-REFERENCE TO RELATED APPLICATIONS

This application claims the benefit of U.S. Provisional Application No. 60/919,319, filed Mar. 21, 2007. The disclosure of the above application is incorporated herein by reference.

BACKGROUND

The present invention relates generally to electrical connectors and, more particularly, to connectors for use with alternating current surface mounted receptacles within motor vehicles.

Operators of cargo carrying vehicles such as Class 7 and Class 8 tractor-trailers may find themselves far away from home a large portion of the time. As such, many of these vehicles are equipped with sleeper cabs to allow the operator to rest within the vehicle during a stationary period. Accordingly, it may be desirable to equip such vehicles with wiring systems to allow use of common household electrical devices such as lap top computers, microwaves, televisions and the like.

Based on the wide variety of electrical appliances that may be used within the vehicle, it may be desirable to provide designated circuits having maximum amperage ratings that vary from one another. For example, many homes are equipped with 15 amp circuits as well as 20 amp circuits to meet the demand of the particular appliance or appliances to be electrically energized. It may also be desirable to equip a vehicle with electrical hardware configured to provide different amperage circuits. As such, a need may exist to assure that the various components used to create the different amperage circuits are not interchanged with one another. Additionally, it may be desirable to assure that a receptacle sized to transfer a certain maximum amperage is not inadvertently connected to components rated to carry a lesser current load.

SUMMARY

A wiring arrangement for interconnecting an alternating current power source to a receptacle within a motor vehicle includes a first wire harness having a current rating and a second wire harness having a similar current rating. A coupling mechanism electrically interconnects the first and second wire harnesses of similar current ratings. The coupling mechanism restricts interconnection of wire harnesses having dissimilar current ratings.

In addition, a cord set for electrically connecting a receptacle within a vehicle to an alternating current power source includes a first wire harness having a first end and a second end. The first end has a first connector adapted to be electrically connected to the power source. The cord set also includes a second wire harness having a first end and a second end. The first end has a second connector adapted to be selectively connected to the receptacle within the vehicle. A coupling mechanism electrically couples the first wire harness to the second wire harness. The coupling mechanism includes a first housing fixedly attached to the second end of the first wire harness. The first housing includes a projection radially outwardly extending therefrom, a radially inwardly protruding and axially extending rib and a circumferentially extending recess positioned radially between the rib and the projection. A second housing is fixedly attached to the second end of the second wire harness. The second housing includes a flexible finger having an aperture for receiving the projection, an axially extending groove for receiving the rib and a cylindrical wall for insertion within the recess.

In addition, the present disclosure provides cord sets for connecting electrical receptacles mounted within a vehicle to a power source. A first cord set has a first wire harness having a first current rating, a second wire harness having the first current rating and a first coupling mechanism electrically interconnecting the first and second wire harnesses. A second cord set has a third wire harness having a second current rating greater than the first current rating, a fourth wire harness having the second current rating and a second coupling mechanism electrically interconnecting the third and fourth wire harnesses. The first and second coupling mechanisms prevent electrical connection of wire harnesses having dissimilar current ratings.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
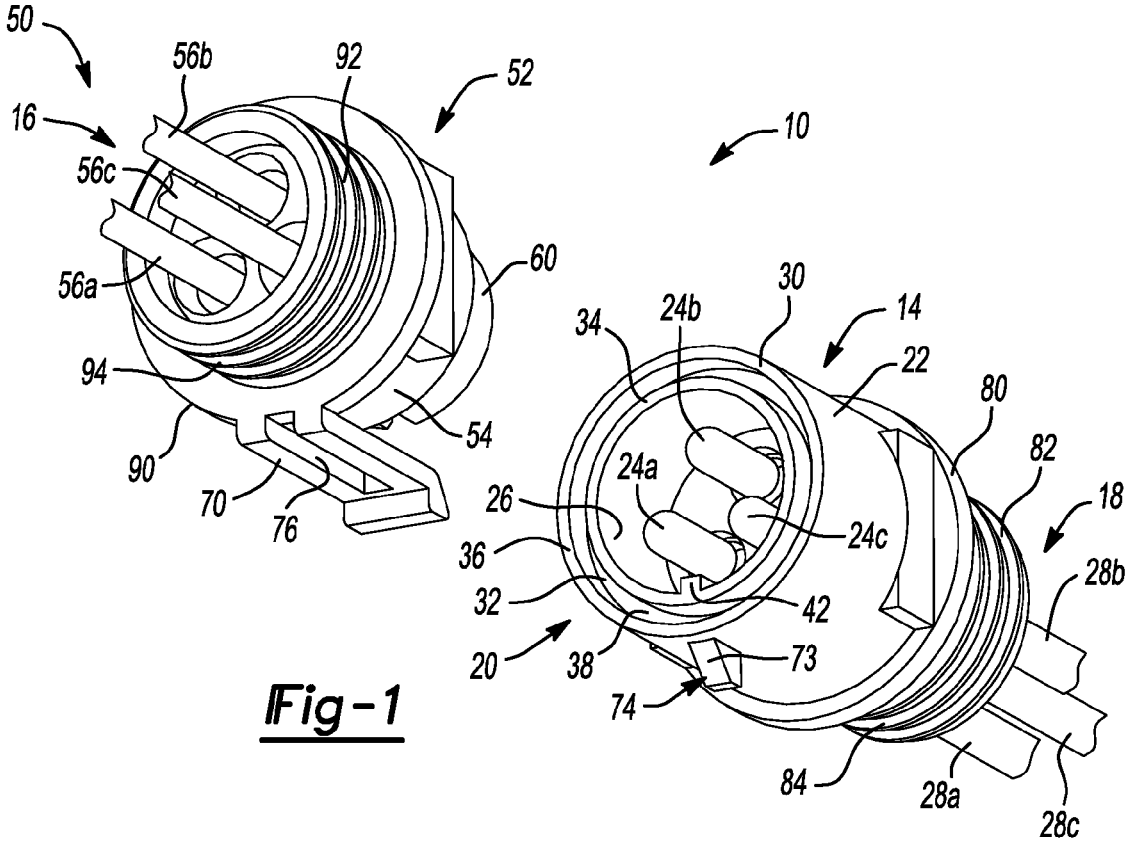
FIG. 1 is a fragmentary exploded perspective view of a first electrical connector assembly.

The following description is merely exemplary in nature and is not intended to limit the present disclosure, application, or uses. It should be understood that throughout the drawings, corresponding reference numerals indicate like or corresponding parts and features.

The present disclosure provides a first electrical connector assembly 10 and a second electrical connector assembly 12. Each of the connector assemblies 10, 12 perform substantially similar functions providing a connection/disconnection between two wire harnesses. It is contemplated that each of connector assemblies 10, 12 may be used in conjunction with systems providing 120 volt alternating current from a power source to a receptacle within a motor vehicle. One such system is described in commonly owned U.S. Pat. No. 6,644,987 which is herein incorporated by reference.

Figure 2:
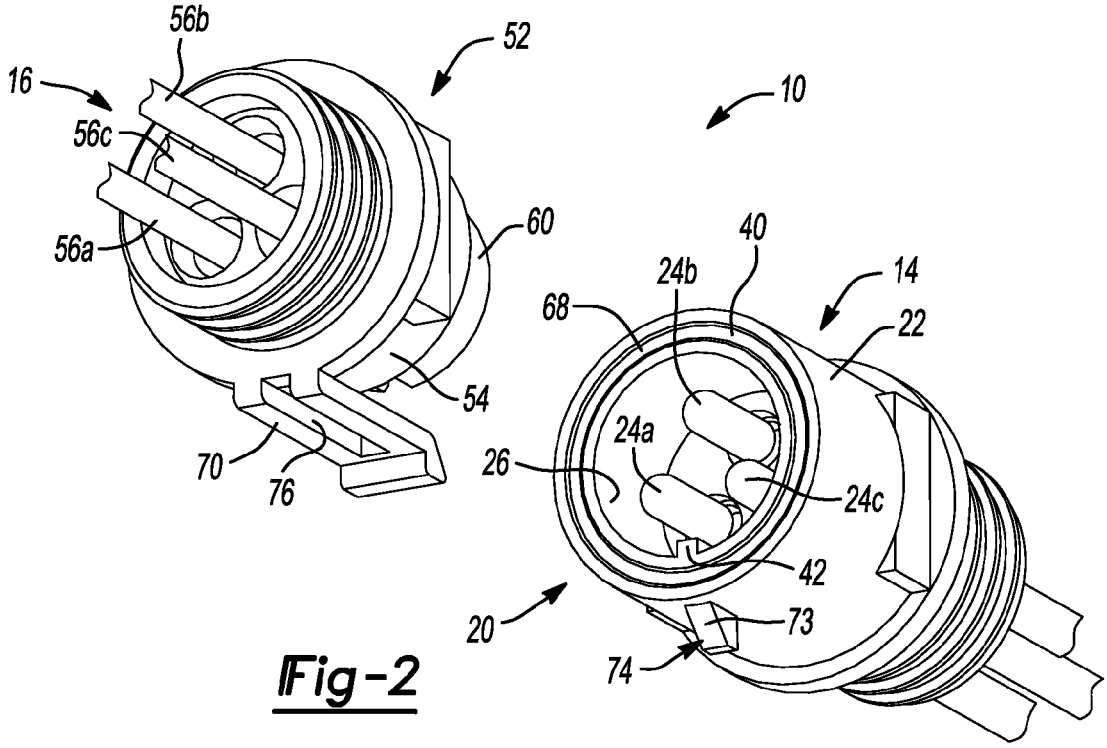
FIG. 2 is a fragmentary exploded perspective view of the electrical connector assembly shown in FIG. 1 including an elastomeric gasket.
Figure 3:
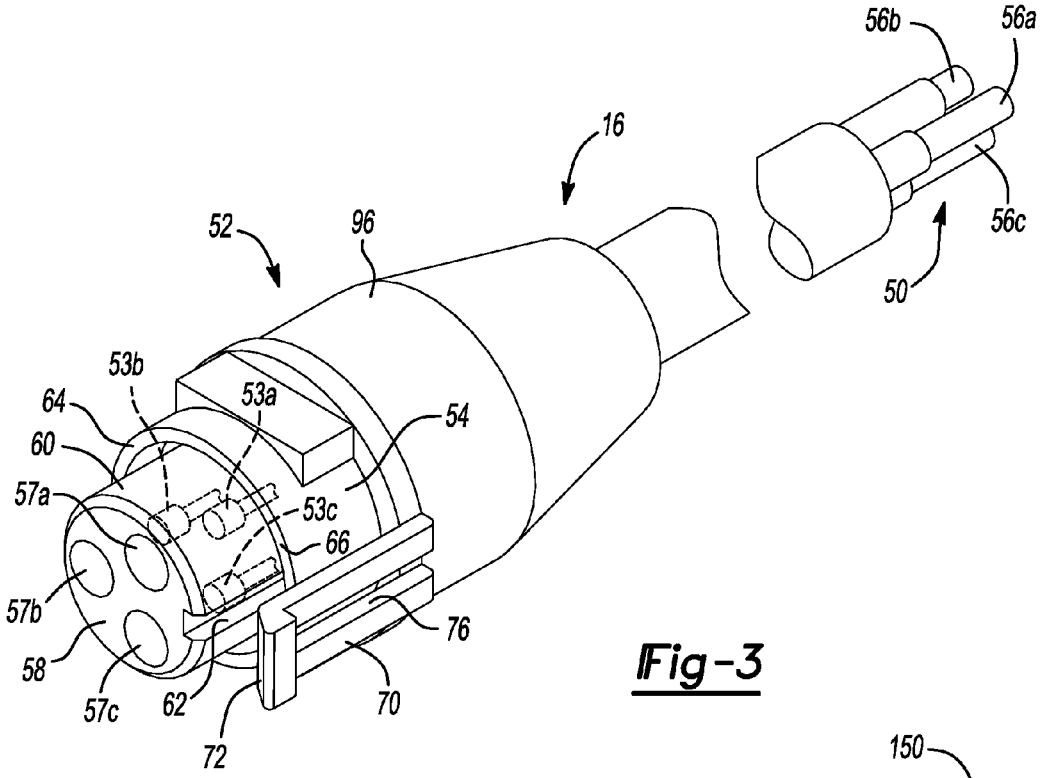
FIG. 3 is a fragmentary perspective view of a wire harness having an overmolded sheath.

FIGS. 1-3 depict first connector assembly 10 or a portion thereof. First connector assembly 10 is designed for use with one of a 15 amp supply circuit or a 20 amp circuit. For purposes of clarity of description, connector assembly 10 will be described in relation to the 15 amp circuit but may be utilized to provide other current levels.

Connector assembly 10 includes a first wire harness 14 and a second wire harness 16. First wire harness 14 includes a first end 18 adapted to be coupled to a power source. First end 18 is not shown in detail but may include terminals and/or a plug to electrically connect first wire harness 14 to the power source. First wire harness 14 also includes a second end 20 having a housing 22. A plurality of male current-carrying pins or electrical terminals 24*a*, 24*b*, 24*c* are mounted to housing 22 and positioned within a cavity 26 formed within housing 22. Terminals 24*a*, 24*b*, 24*c* are in electrical communication with wires 28*a*, 28*b*, 28*c*, respectively, extending through housing 22. Housing 22 includes an end face 30 having a circular groove 32 formed therein. As such, an inner wall 34 and an outer wall 36 are formed bounding groove 32. Groove 32 terminates at a back wall 38 extending between inner wall 34 and outer wall 36. FIG. 2 shows an elastomeric gasket 40 positioned within groove 32. Housing 22 includes a radially inwardly protruding and axially extending rib 42. Rib 42 is integrally formed with and extends from inner wall 34.

Second wire harness 16 includes a first end 50 adapted to be connected to a receptacle (not shown) mounted within a vehicle. A second end 52 of second wire harness 16 is configured to be mechanically and electrically coupled to second end 20 of first wire harness 14. Second end 52 includes a housing 54 in receipt of female electrical terminals 53*a*, 53*b* and 53*c* as shown in FIG. 3. The female electrical terminals are electrically coupled to wires 56*a*, 56*b*, 56*c* that extend through housing 54. More particularly, terminal 53*a* is fixed in electrical communication with wire 56*a*. Terminal 53*b* is fixed in electrical communication with wire 56*b*. Terminal 53*c* is fixed in electrical communication with wire 56*c*. Housing 54 includes a central protruding boss 60 having an end face 58 formed thereon. Each female electrical terminal 53*a*, 53*b*, 53*c* is positioned within one of pockets 57*a*, 57*b*, 57*c* inwardly extending from end face 58 of housing 54.

Boss 60 further includes an axially extending groove 62 sized to receive rib 42 during insertion of boss 60 within cavity 26. While male current-carrying pins 24*a*, 24*b*, 24*c* and female electrical terminals 53*a*, 53*b*, 53*c* function to rotationally orient housing 54 with housing 22, rib 42 and groove 62 provide another rotational alignment feature to assure that certain male terminals 24 are coupled to the appropriate female electrical terminals 53 of second wire harness 16.

Housing 54 also includes a cylindrical wall 64 encompassing a portion of boss 60. An end face 66 of wall 64 is axially offset and substantially parallel to end face 58. Cylindrical wall 64 is sized and positioned to engage gasket 40 and become at least partially positioned within groove 32 between inner wall 34 and outer wall 36 when second end 52 is coupled to second end 20. In particular, end face 66 of wall 64 engages an outer surface 68 of gasket 40.

An axially extending flexible finger 70 is integrally formed with housing 54 and axially extends parallel to boss 60. A radially outwardly extending protrusion or peg 74 is integrally formed with housing 22. Once rib 42 and groove 62 are rotationally aligned with one another, housing 54 may be moved toward housing 22 to couple second end 52 to second end 20. During relative translation toward one another, a lead chamfer 72 of finger 70 engages a sloped surface 73 of peg 74. Finger 70 is deflected radially outwardly at this time. Once peg 74 enters a slot 76 formed in finger 70, the catch returns toward its undeformed state and captures peg 74. Finger 70 and peg 74 engage one another in a snap-fit arrangement to resist forces tending to separate first wire harness 14 from second wire harness 16. At this time, each male electrical terminal 24*a*, 24*b*, 24*c* is positioned in electrical communication with its associated female electrical terminal 53*a*, 53*b*, 53*c*. It should be appreciated that flexible finger 70 and peg 74 act to rotationally align housing 22 and housing 54 as well.

To aid in possibly mounting housing 22 or housing 54 to a rigid structure, housing 22 includes a radially extending flange 80 and a reduced diameter tubular portion 82 axially extending therefrom. An external thread 84 is formed on tubular portion 82. A threaded nut (not shown) may be threadingly engaged with thread 84 to mount housing 22 to a desired structure. In similar fashion, housing 54 includes a radially extending flange 90. A reduced diameter tubular portion 92 axially extends from flange 90. An external thread 94 is formed on tubular portion 92.

FIG. 3 depicts an optional sheath 96 coupled to housing 54. Sheath 96 may be fixed to housing 54 in a pressed fit manner or a threaded engagement. Sheath 96 may alternatively be overmolded about housing 54. In the latter arrangement, housing 54, terminals 53*a*, 53*b*, 53*c* and wires 56 are placed into a cavity of an injection mold. Molten polymer is injected within the cavity to surround tubular portion 92 and a portion of wires 56. The overmolding process produces a robust, sealed second end 52. It should be appreciated that another sheath (not shown) may be coupled to tubular portion 82 of housing 22.

Figure 4:
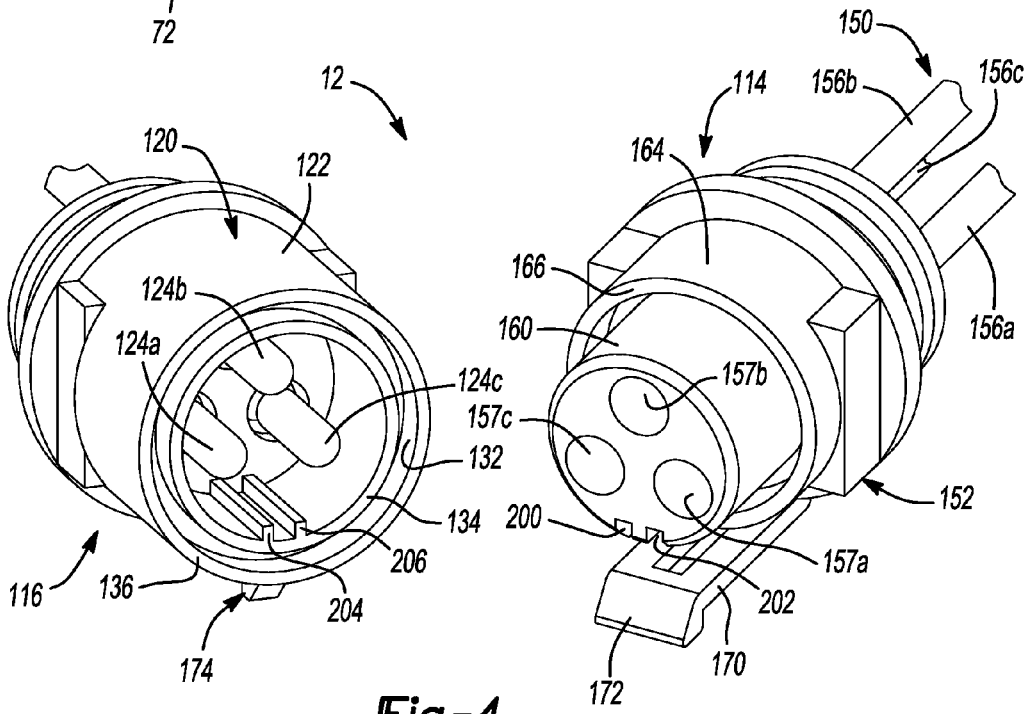
FIG. 4 is a fragmentary exploded perspective of another electrical connector assembly.

FIG. 4 depicts second connector assembly 12. Second connector assembly 12 is designed for use with circuits of different current ratings than first connector assembly 10. For example, second connector assembly 12 is configured for use with 20 amp circuits. It should be appreciated that second electrical connector assembly 12 is substantially similar to the first electrical connector assembly 10. As such, like elements will be identified with similar reference numerals increased by 100. One skilled in the art will appreciate that different regulatory standards exist regarding circuits carrying various current levels. For example, a 20 amp circuit may be required to include wires having a heavier gauge than the wires used for 15 amp circuits. Terminal designs may also differ. Accordingly, it may be desirable to provide unique connectors for different current-carrying sets of wire harnesses that allow interconnection of like amperage rated wire harnesses but do not allow interconnection of unlike current rated wire harnesses. In particular, it may be desirable to assure that second wire harness 16 associated with a 15 amp circuit may not be coupled to a third wire harness 114 associated with a 20 amp circuit.

Third wire harness 114 includes a boss 160 having a first groove 200 and a second groove 202. The grooves are spaced apart from one another and axially extend along boss 160. To provide a properly mated interconnection, a fourth wire harness 116 includes a second end 120 having a housing 122. Housing 122 includes an inner wall 134 and an outer wall 136 bounding a groove 132. A first radially inwardly protruding and axially extending rib 204 is integrally formed with inner wall 134. A second radially inwardly protruding and axially extending rib 206 is also integrally formed with inner wall 134. Ribs 204 and 206 are spaced apart from one another and positioned substantially parallel to each other. Ribs 204, 206 are spaced apart and sized to be received within grooves 200, 202 formed on boss 160.

It should be appreciated that groove 132 is sized for receipt of a gasket (not shown) and that the interconnection between second end 120 and second end 152 is substantially similar to the sealing arrangement and catch retention design previously described in relation to first electrical connector assembly 10. As such, the description will not be repeated. The dual rib feature of housing 122 and the dual groove feature of boss 160 assure electrical connection of only 20 amp circuit wire harnesses with one another. Similarly, the position of the single rib 42 of housing 22 as well as the single groove 62 of boss 60 restrict the interconnection of a 15 amp harness with a 20 amp harness but allow the electrical coupling of like amperage wire harnesses.

Furthermore, the foregoing discussion discloses and describes merely exemplary embodiments of the present disclosure. One skilled in the art will readily recognize from such discussion, and from the accompanying drawings and claims, that various changes, modifications and variations may be made therein without departing from the spirit and scope of the disclosure as defined in the following claims.

What is claimed is:

1. A wiring arrangement for interconnecting an alternating current power source to a receptacle within a motor vehicle, comprising:

a first wire harness having a predetermined current rating;

a second wire harness having a similar current rating; and a coupling mechanism electrically interconnecting the first and second wire harnesses of similar current ratings, the coupling mechanism restricting interconnection of wire harnesses having dissimilar current ratings and including a first housing coupled to the first wire harness and one of a plurality of electrical sockets and a plurality of current-carrying pins coupled thereto, the first housing including a boss and cylindrical wall circumscribing the boss, the wall having an end face offset from an end face of the boss, the boss being positioned within the receptacle and the cylindrical wall being positioned within a groove of the second housing circumscribing the receptacle, the coupling mechanism including a second housing including a receptacle for receiving a portion of the first housing and the other of the plurality of electrical sockets and the plurality of current-carrying pins, the current-carrying pins conducting electricity to the electrical sockets when the first housing is coupled to the second housing, wherein the coupling mechanism includes first, second and third means for rotationally aligning the first and second housing, wherein at least one of the means for rotational aligning includes an axially extending rib formed on one of the first and second housings and a mating groove formed on the other of the first and second housings, wherein the rib and the groove mate with one another to allow interconnection of housings having common current ratings and resist interconnection with housings having different current ratings.

2. The wiring arrangement of claim 1 wherein each of the first and second housings includes an externally threaded cylindrical portion, the coupling mechanism further including an overmolded sheath engaging one of the threaded cylindrical portions.

3. A cord set for electrically connecting a receptacle within a vehicle to an alternating current power source, the cord set comprising:

a first wire harness having a first end and a second end, said first end having a first connector adapted to be electrically connected to the power source;

a second wire harness having a first end and a second end, said first end having a second connector adapted to be selectively connected to the receptacle within the vehicle; and a coupling mechanism electrically coupling said first wire harness to said second wire harness, said coupling mechanism including:

a first housing fixedly attached to said second end of said first wire harness, said first housing including a projection radially outwardly extending therefrom, a radially inwardly protruding and axially extending rib and a circumferentially extending recess positioned radially between the rib and the projection; and a second housing fixedly attached to said second end of said second wire harness, said second housing including a flexible finger having an aperture for receiving the projection, an axially extending groove for receiving the rib and a cylindrical wall for insertion within the recess.

4. The cord set of claim 3 wherein said projection is operable to enter said aperture in a snap-fit arrangement to connect said first housing to said second housing.

5. The cord set of claim 4 wherein said first housing includes one of a plurality of current-carrying pins and a plurality of electrical sockets, said second housing including the other of said current-carrying pins and said electrical sockets, said current-carrying pins being matingly received by the electrical sockets to transmit electricity between said first and second housings.

6. The cord set of claim 5 wherein said first housing includes a boss having said groove formed thereon, said boss axially extending beyond an end face of said cylindrical wall.

7. The cord set of claim 3 wherein each of the first and second housings includes an externally threaded cylindrical portion, the coupling mechanism further including an overmolded sheath engaging one of the threaded cylindrical portions.

8. Cord sets for connecting electrical receptacles mounted within a vehicle to a power source, the cord sets comprising:

a first cord set having a first wire harness having a first current rating, a second wire harness having the first current rating and a first coupling mechanism electrically interconnecting the first and second wire harnesses; and a second cord set having a third wire harness having a second current rating greater than the first current rating, a fourth wire harness having the second current rating and a second coupling mechanism electrically interconnecting the third and fourth wire harnesses, the first and second coupling mechanisms preventing electrical connection of wire harnesses having dissimilar current ratings, wherein the first coupling mechanism includes a first housing coupled to the first wire harness and includes one of a plurality of electrical sockets and a plurality of current-carrying pins coupled thereto, the first housing including a boss and a cylindrical wall circumscribing the boss, the wall having an end face offset from an end face of the boss, wherein the boss is positioned within the receptacle and the cylindrical wall is positioned within a groove of the second housing circumscribing the receptacle, the first coupling mechanism including a second housing including a receptacle for receiving a portion of the first housing and the other of the plurality of electrical sockets and the plurality of current-carrying pins, the current-carrying pins conducting electricity to the electrical sockets when the first housing is coupled to the second housing, wherein the first coupling mechanism includes first, second and third means for rotationally aligning the first and second housing, wherein at least one of the means for rotational aligning includes an axially extending rib formed on one of the first and second housings having a predetermined current rating and a mating groove formed on the other of the first and second housings having a similar current rating, wherein the rib and the groove resist interconnection with housings having other than the predetermined current rating.

9. The cord sets of claim 8 wherein each of the first and second housings includes an externally threaded cylindrical portion, the coupling mechanism further including an overmolded sheath engaging one of the threaded cylindrical portions.

* * * * *